United States Patent [19]

Walto

[11] 4,078,726

[45] Mar. 14, 1978

[54] LAWN SPRINKLER

[75] Inventor: Joseph J. Walto, Riverside, Calif.

[73] Assignee: The Toro Company, Minneapolis, Minn.

[21] Appl. No.: 711,135

[22] Filed: Aug. 3, 1976

[51] Int. Cl.[2] ..... B05B 15/10; B05B 15/02

[52] U.S. Cl. ..... 239/205; 239/113; 239/590

[58] Field of Search ..... 239/201, 203–206, 239/110, 113, 228, 590, 590.5

[56] References Cited

U.S. PATENT DOCUMENTS

| | | | |
|---|---|---|---|
| 223,332 | 1/1880 | Fox | 239/590 |
| 1,203,542 | 10/1916 | Hawley | 239/204 |
| 1,901,655 | 3/1933 | Keys | 239/228 |
| 3,268,173 | 8/1966 | Costa | 239/206 |
| 3,272,436 | 9/1966 | Hunter | 239/204 |
| 3,335,959 | 8/1967 | Lockwood | 239/204 |
| 3,503,555 | 3/1970 | Lockwood et al. | 239/204 |
| 3,921,910 | 11/1975 | Hayes et al. | 239/205 |

*Primary Examiner*—Robert W. Saifer
*Attorney, Agent, or Firm*—Merchant, Gould, Smith, Edell, Welter & Schmidt

[57] ABSTRACT

A pop-up sprinkler having a vertically extensible and retractable spray head assembly and means for flushing the channel in which the assembly moves with outflowing water both when the assembly extends and when it retracts, the arrangement permitting the use of a strainer built into the spray head assembly and replaceable, after installation of the sprinkler by simply removing a spray head.

8 Claims, 9 Drawing Figures

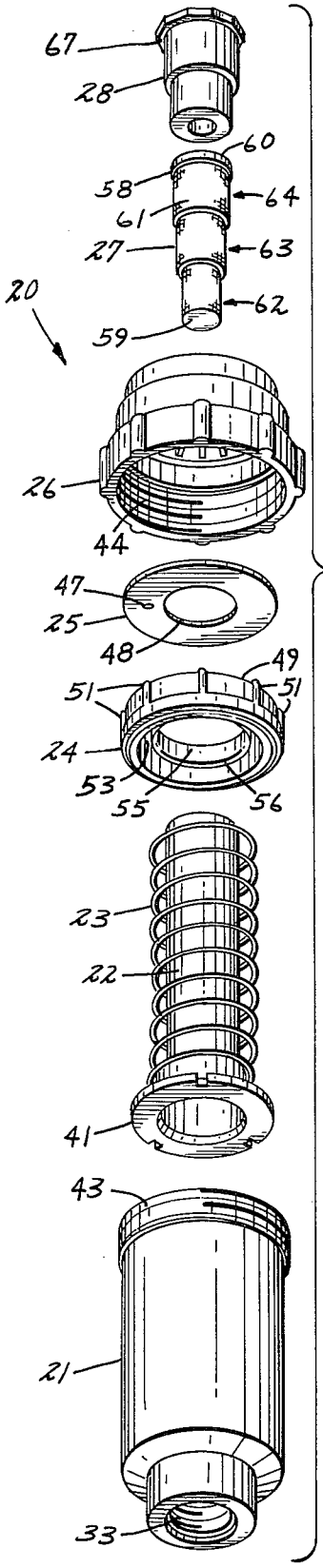
FIG. 1
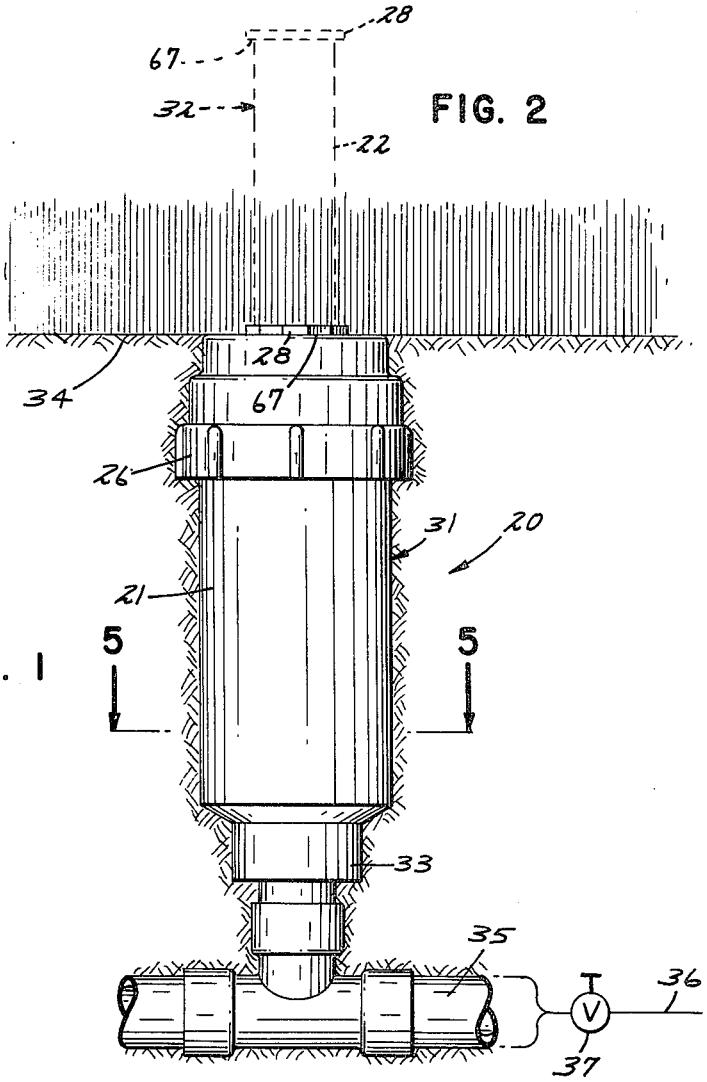
FIG. 2
FIG. 8
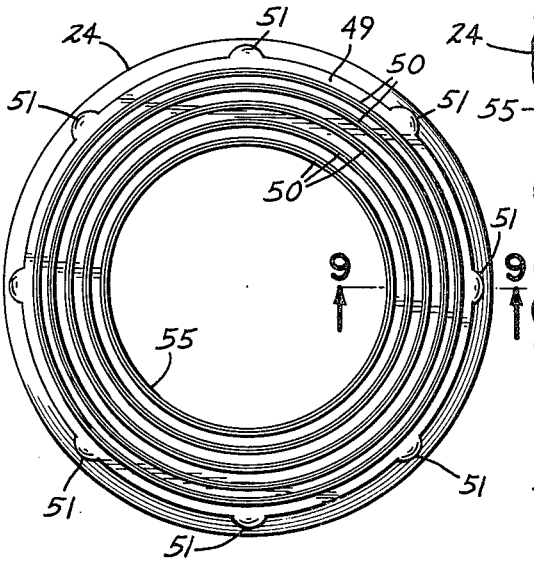
FIG. 9
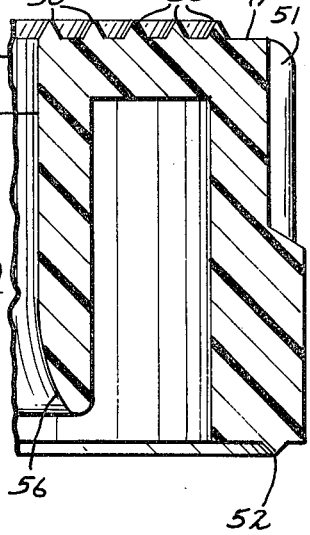

LAWN SPRINKLER

BACKGROUND OF THE INVENTION

This invention relates to the field of lawn maintenance and particularly to sprinklers of the pop-up type which are permanently installed in the lawn and supplied with water at will or on schedule by remote valve operation. Such sprinklers are known, but in the past have suffered from certain imperfections. Permanently installed equipment should operate without failure for long intervals, but it has been found common for unwanted material to find its way into the path of the moving members of such sprinklers, particularly during their retraction. In an effort to overcome this, it has been proposed, in Hayes et al. U.S. Pat. No. 3,921,910, for example, to provide a wiping seal which engages the moving member and removes particles as they reach the seal. It will be realized that under conditions where considerable unwanted material may accumulate, the patented structure may amass so much material as to render itself inoperative.

It is also desirable to prevent water borne material from reaching the spray heads and clogging them. Strainers are common in water lines, but are not always effective for desirable intervals, and are frequently difficult or inconvenient to remove for cleaning or replacement.

SUMMARY OF THE INVENTION

I have determined that it is possible to so construct a pop-up sprinkler that it automatically flushes with water the space through which the moving element rises, not only each time the water is turned on, but also each time the water is turned off. This avoids the friction of a wiping seal, and also carries any offending particles away from the sensitive area. The design also results in an arrangement in which a strainer may be so constructed and positioned as to maximize its period of use between removals, as well as to render such removals easy from the surface of the ground in which the sprinkler is embedded.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing,

FIG. 1 is an exploded view of apparatus embodying my invention;

FIG. 2 is an elevational view of my invention as installed;

FIG. 8 is a plan view of a component of my invention, to a larger scale; and

FIG. 9 is a sectional view along the line 9—9 of FIG. 8.

DESCRIPTION OF THE PREFERRED EMBODIMENT

Figure 3:
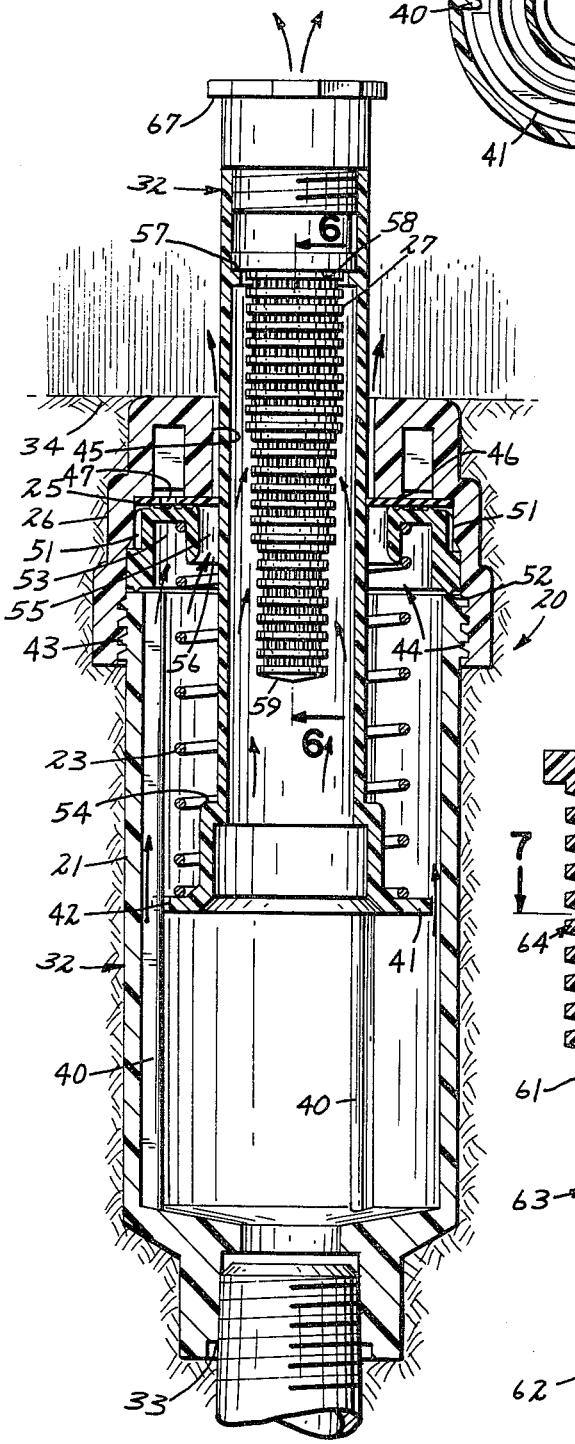
FIG. 3 is a longitudinal sectional view of a pop-up sprinkler according to my invention, to a larger scale.

The principal components of a sprinkler 20 according to my invention, and their general relationship, are given in FIG. 1. They include a body 21, a riser 22, a compression spring 23, a seal retainer 24, a seal 25, a cap 26, a strainer 27, and a spray head 28. Body 21 and cap 26 coact to form a hollow body or housing 31, and riser 22, strainer 27, and head 28 coact to form a spray head assembly 32, which is movable axially in housing 31 and is normally retracted into housing 31 by spring 23, but may be extended through cap 26 when water under pressure is supplied to a connection 33 at one end of body 21.

As is conventional with pop-up sprinklers, the unit is intended to be buried in the soil 34 (FIG. 2) so that only the upper surface of cap 26 is visible, and to be connected by suitable piping 35 to a source 36 of water under pressure having a conventional shut-off valve 37. Sprinklers of this sort are usually installed in sets, located at strategic points in and around an area of lawn to be watered, and spray heads are known for discharging water over circular areas, as well as semi-circular and quadrantal areas.

Figure 5:
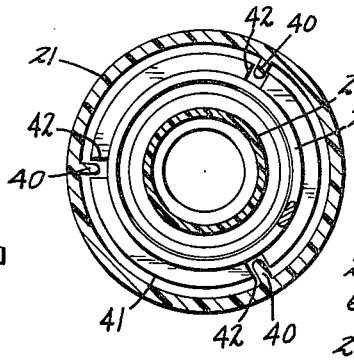
FIG. 5 is a sectional view along the line 5—5 of FIG. 2, to a larger scale.

Referring now to FIGS. 3 and 5, it is to be noted that body 21 includes a plurality of internal ribs 40 parallel to the axis of the body, and that riser 22 terminates inwardly in a flange 41 having notches 42 into which ribs 40 fit, thus allowing axial but not rotary movement of the riser in the housing. Body 21 is provided with external threads 43 for engaging internal threads 44 in cap 26.

The cap includes a central aperture 45 through which the main body of riser 22 may pass freely, although it is too small to permit the passage of flange 41 or head 28. An internal shoulder 46 in cap 26 surrounds aperture 45, and a first face of seal 25, of flat resilient material, rests against shoulder 46, being held in place by retainer 24. In addition to a pressure equalizing opening 47, seal 25 has a principal aperture 48 which is a snug but not wiping fit around riser 22.

As seen in FIGS. 8 and 9, retainer 24 has a flat surface 49 from which small circumferential ridges 50 project axially to engage the second face of seal 25 and hold it in position. Retainer 24 also has a plurality of external axial ribs 51 which are an interference fit in cap 26, so that when seal 25 is positioned and retainer 24 is pressed into place, the seal is held securely and permanently in the cap. The housing is separable at threads 43, 44, and member 24 may have a sealing edge 52 if desired.

As is seen in the figures, one end of spring 23 engages flange 41 of riser 22: the other end of the spring is received in a recess 53 in retainer 24, and thus tends to retract assembly 32 into housing 31. Seal 25 is not designed to prevent flow of liquid between riser 22 and cap 26, as would an O-ring. It is rather designed for direct axial engagement by a shoulder 54 at the inner end of the riser near flange 41. This engagement occurs when the spray head assembly is fully extended from body 21, and continues during continuance of that extension.

Near the completion of this extension, shoulder 54 enters a large central aperture 55 in retainer 24, being guided by a slightly tapered lip 56.

Figure 6:
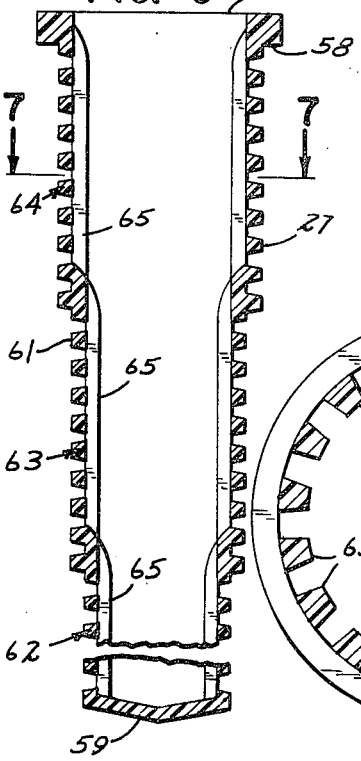
FIG. 6 is a fragmentary sectional view along the line 6—6 of FIG. 3, to a larger scale, parts being omitted for clarity of illustration.
Figure 7:
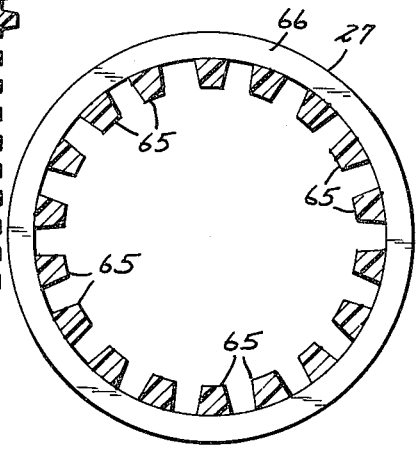
FIG. 7 is a sectional view along the line 7—7 of FIG. 6, to a larger scale.

An internal shoulder 57 is provided in riser 22, to engage an external shoulder 58 on one end of strainer 27. The strainer is generally cylindrical, having a closed end 59 and an open end 60 connected by a perforated surface 61. More exactly, surface 61 is in the form of three apposed cylindrical portions 62, 63 and 64 of slightly different diameter, the smallest portion 62 being nearest closed end 59 and the largest portion 64 being nearest open end 60. The differences in diameter are small, being comparable to half the wall thickness of the portion. As shown in FIGS. 6 and 7, each of these portions is made up of a plurality of circumferentially spaced internal longitudinal ribs 65 joined by a plurality of axially spaced external circumferential ribs 66. By preference, the number of longitudinal ribs is the same in all the portions and to protect against clogging of the spray head, it has been found preferable to have the perforations in the strainer approximately one-fourth the size of the spray head apertures.

Figure 4:
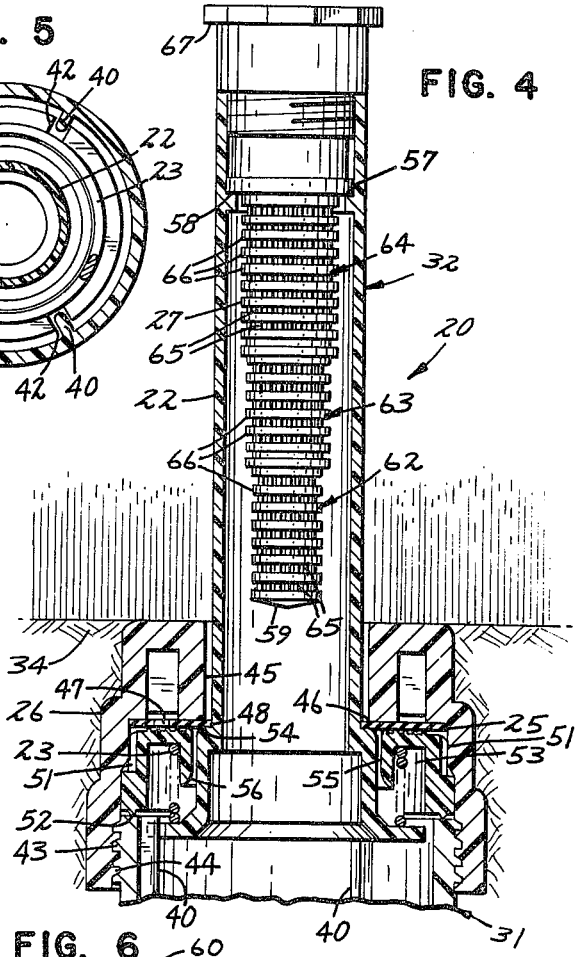
FIG. 4 is a fragmentary view similar to FIG. 3 showing a different position of certain components.

The operation of my sprinkler can now be explained. Between periods of use, assembly 32 is retracted into housing 31 by spring 23 until an outer shoulder 67 on spray head 28 engages cap 26, overlying the space between the cap and the assembly to prevent entry of undesired material thereinto. When sprinkling is desired, valve 37 is opened, admitting water under pressure to housing 31. The water can find immediate egress through riser 22, strainer 27, and spray head 28, and also around spring 23 and between riser 22 and retainer 24, seal 25, and cap 26. This second path is effective to flush out of the space around riser 22 any particulate matter therein and also to prevent entry of particulate matter into that space. Spray head 28 offers resistance to liquid flow so that a pressure head rises in housing 31, acting on assembly 32 as a piston to move it bodily in an outward direction until shoulder 54 engages seal 25, as shown in FIG. 4. The liquid flow around the riser is then cut off as long as the water pressure is maintained in the housing.

Now, when the water is cut off at valve 37, the pressure in housing 31 drops with continued discharge of water through the spray head until it becomes less than the force necessary to compress spring 23. Assembly 32 begins to retract, shoulder 54 moving away from seal 25, and a short flow of water past the riser takes place energized by extension of the spring, to again cause liquid flow past riser 22 as it settles to its retracted position, thus preventing entry of undesired material during this critical interval.

Although seal 25 does not entirely prevent the flow of water past riser 22, it nevertheless is a sufficiently close fit to resiliently oppose such flow. This assures that if the water pressure at source 36 should be low, less flow past seal 25 takes place, and pop-up operation of assembly 32 is not prevented by excess of flow around it.

All the water which flows through head 28 must first flow through strainer 27, and if the water contains particulate impurities they are caught by the strainer to prevent damage to the spray head. If strainer 27 becomes clogged, it is only necessary to lift assembly 32 against the force of spring 22 and unscrew head 28, whereupon strainer 27 may easily be extracted for cleaning or replacement. The plural diameters of strainer 27 are advantageous if impurities of different sizes are to be anticipated, but also facilitate the removal of the strainer when necessary, since they result in less tendency for binding between the strainer and the riser.

A number of modifications of the structure illustrated will be apparent. For example, retraction of assembly 32 within housing 31 could be brought about by a weight rather than a spring, or the housing might be inverted so that assembly 32 extends through a fixed end of the housing instead of through a removable cap: the housing might then disassemble near the water connection. Such modifications come within the ambit of my invention.

From the above, it will be evident that I have invented a new and improved pop-up sprinkler in which motility of the moving element is optimized by provision of flushing water each time the riser moves, either upward or downward, no sealing friction acting to impede the motion. The portion of the water which feeds the spray head is rendered free of undesired particles by a strainer positioned and configured for maximum intervals between replacement and for ease in performance of such replacement when it becomes necessary.

In one satisfactory embodiment of the invention, members 21, 22, 26 and 28 were of the plastic known as ABS, members 24 and 27 were of polyethylene, and member 25 was of buna rubber.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a pop-up sprinkler comprising:

a hollow body elongated along an axis and having a connection at one end for admission of liquid under pressure, the other end of the body having a central aperture surrounded by an internal flat shoulder, a hollow elongated sprinkler head assembly movable axially in said housing and extensible through said aperture in response to liquid pressure, and resilient means normally acting to retract said assembly into said housing with a force smaller than that exertible by said liquid, said assembly including a spray head restricting the flow of liquid therethrough, so that when liquid under pressure is supplied at said connection, liquid initially passes out both at said spray head and between said body and said assembly, and said assembly is extended through said aperture, the improvement which comprises:

1. a flat resilient inner seal extending across said one end against said shoulder, and having a central aperture to provide substantially free axial passage for said assembly,
2. a seal retainer having an aperture surrounded by a seal retaining surface, said seal retainer being securable within said body to sandwich an outer portion of said seal against an outer portion of said internal shoulder,
3. and an external shoulder near the inner end of said assembly for flat axial engagement with an inner portion of said seal when said assembly is extended, to prevent liquid flow between said body and said assembly during continuance of liquid pressure in said housing.

2. The structure of claim 1 in which the seal retainer is a cylindrical cap-like structure with a central aperture therein and includes a plurality of external projections which secure the retainer to prevent rotation thereof in said body.

3. The structure of claim 1 in which the seal retainer means includes means for guiding said shoulder of said assembly into engagement with said seal.

4. The structure of claim 1 in which said retainer is provided with an internal circular groove and said resilient means acts at one end to engage the seal retaining means in said body.

5. The structure of claim 1 in which the seal retainer means includes a flat annular face having circumferential ribs for pressing the outer portion of said seal against said internal shoulder.

6. In a pop-up sprinkler comprising:

a housing elongated along an axis and having a connection at one end for admission of liquid under pressure, the other end of the housing being open, a removable cap for the open end of said housing having a central aperture surrounded by an internal flat shoulder, a hollow elongated sprinkler head assembly movable axially in said housing and extensible through said cap in response to liquid pressure, said assembly comprisng an apertured spray head removably secured to a riser at the outlet end thereof, and means normally acting to retract said assembly into said housing with a force smaller than that exertible by said liquid, the improvement which comprises:

1. an internal shoulder in said riser near said spray head, 2. a generally cylindrical strainer in said riser having a closed end and an open end joined by a perforated surface, configured as a plurality of axially apposed cylinders of slightly different diameters, the largest being near the open end and the smallest being near the closed end, with an external shoulder for engaging said internal shoulder in said riser, and 3. means carried by said spray head for retaining said strainer in said riser.

7. In a pop-up sprinkler comprising:

a housing elongated along an axis and having a connection at one end for admission of liquid under pressure, the other end of the housing being open, a removable cap for the open end of said housing having a central aperture surrounded by an internal flat shoulder, a hollow elongated sprinkler head assembly movable axially in said housing and extensible through said cap in response to liquid pressure, said assembly comprising an apertured spray head removably secured to a riser at the outlet end thereof, and means normally acting to retract said assembly into said housing with a force smaller than that exertible by said liquid, the improvement which comprises:

1. an internal shoulder in said riser near said spray head, 2. a generally cylindrical strainer in said riser having a closed end and an open end joined by a perforated surface, with said perforated surface being composed of circumferentially spaced internal longitudinal ribs interconnected by axially spaced external circumferential ribs, and an external shoulder for engaging said internal shoulder in said riser, and 3. means carried by said spray head for retaining said strainer in said riser.

8. The structure of claim 7 in which the perforations in the strainer are about one-fourth the size of apertures in the spray head.

* * * * *